US005657794A

United States Patent [19]

Briner et al.

[11] Patent Number: 5,657,794

[45] Date of Patent: Aug. 19, 1997

[54] CARRIAGE FOR CHANGING THE HARNESS OR HEALD FRAME IN A LOOM

[75] Inventors: Emil Briner, Winterthur; Georg Senn, Rüti, both of Switzerland

[73] Assignee: Sulzer Rueti AG, Rueti, Switzerland

[21] Appl. No.: 530,490

[22] Filed: Sep. 18, 1995

[30] Foreign Application Priority Data

Oct. 7, 1994 [EP] European Pat. Off. ..... 94810588

[51] Int. Cl.[6] ..... D03J 1/00

[52] U.S. Cl. ..... 139/1 R; 414/560; 28/208

[58] Field of Search ..... 414/560; 139/1 R; 28/208, 201

[56] References Cited

U.S. PATENT DOCUMENTS

| | | | |
|---|---|---|---|
| 4,910,837 | 3/1990 | Fujimoto et al. | 139/1 R |
| 4,934,413 | 6/1990 | Yao . | |
| 5,371,930 | 12/1994 | Lindenmueller et al. | 139/1 R |
| 5,394,596 | 3/1995 | Lindenmuller et al. | 139/1 R |
| 5,450,880 | 9/1995 | Briner | 139/1 R |

FOREIGN PATENT DOCUMENTS

| | | |
|---|---|---|
| 0 592 807 | 4/1994 | European Pat. Off. . |
| 1 535 942 | 5/1970 | Germany . |
| 3708598 | 10/1987 | Germany . |
| 661065 | 6/1987 | Switzerland . |

*Primary Examiner*—Andy Falik

*Attorney, Agent, or Firm*—Townsend and Townsend and Crew LLP

[57] ABSTRACT

A carriage for changing a harness or heald frame on a loom has a frame with a device for offering up the warp beam, a framework which includes a carrier mounted on the frame, and devices mounted on the carrier for offering up the warp stop motions and the heald shafts. Relative movement between the offering-up device is thus prevented due to the fact that the devices are mounted together on the carrier. The carrier is journalled in supports and is pivotable about an axis so that the offering-up devices can automatically align themselves with the corresponding supports

10 Claims, 3 Drawing Sheets

CARRIAGE FOR CHANGING THE HARNESS OR HEALD FRAME IN A LOOM

BACKGROUND OF THE INVENTION

The invention relates to a carriage for changing the harness or heald frame of a loom.

A carriage of this kind is known from the European patent application Ser. No. 93 810 281.1. In this carriage, the receiver apparatuses and the hangers for offering up and receipt are each hinged individually on the carrier. When changing the harness or heald frame, the carriage is placed in a particular position relative to the loom and subsequently the offering up and receipt is initiated by lowering the corresponding apparatuses, the movement plane being fixed by the posts of the framework.

As it is desirable to carry out such a change-over in a short time, this fixing proves to be disadvantageous, of particular during the offering up and receipt of the heald shafts, since, as a rule, the plane of movement determined by the shaft guides in the loom and the plane of movement fixed by the posts of the framework do not align. The reasons for this lie on the one hand with the loom (e.g. the loom is not positioned straight, there is imprecise levelling or an uneven floor) and, on the other hand, with the carriage (e.g. a non-straight position as a result of the load on the carriage).

SUMMARY OF THE INVENTION

The present invention remedies this by providing a carriage which allows the harness or heald frame of a loom to be changed by one person in a short time via alignment of the said plane of movement.

The present invention employs a carriage with a frame on which a device for presenting or offering up the warp beam is mounted. A framework, which includes a carrier, is mounted on the frame, and devices are mounted on the carrier for presenting or offering up equipment such as the warp stop motions unit and the heald shafts. Relative movement between the offering-up devices is thus prevented. The carrier is journalled in supports and is pivotable about an axis so that the offering-up devices can automatically align themselves with the corresponding supports.

The receiver apparatuses and the lever arrangements form a single functional unit that is pivotable about an axis. This enables a problem-free placement of the receiver devices onto the support and prevents relative movement between the heald shafts and the hanger during offering up and receipt of the heald shafts.

The receiver apparatuses are connected via a synchro drive so that any level differences can be compensated for when placing the receiver apparatuses onto the support.

BRIEF DESCRIPTION OF THE DRAWINGS

They show.

DESCRIPTION OF THE PREFERRED EMBODIMENTS

Figure 1:
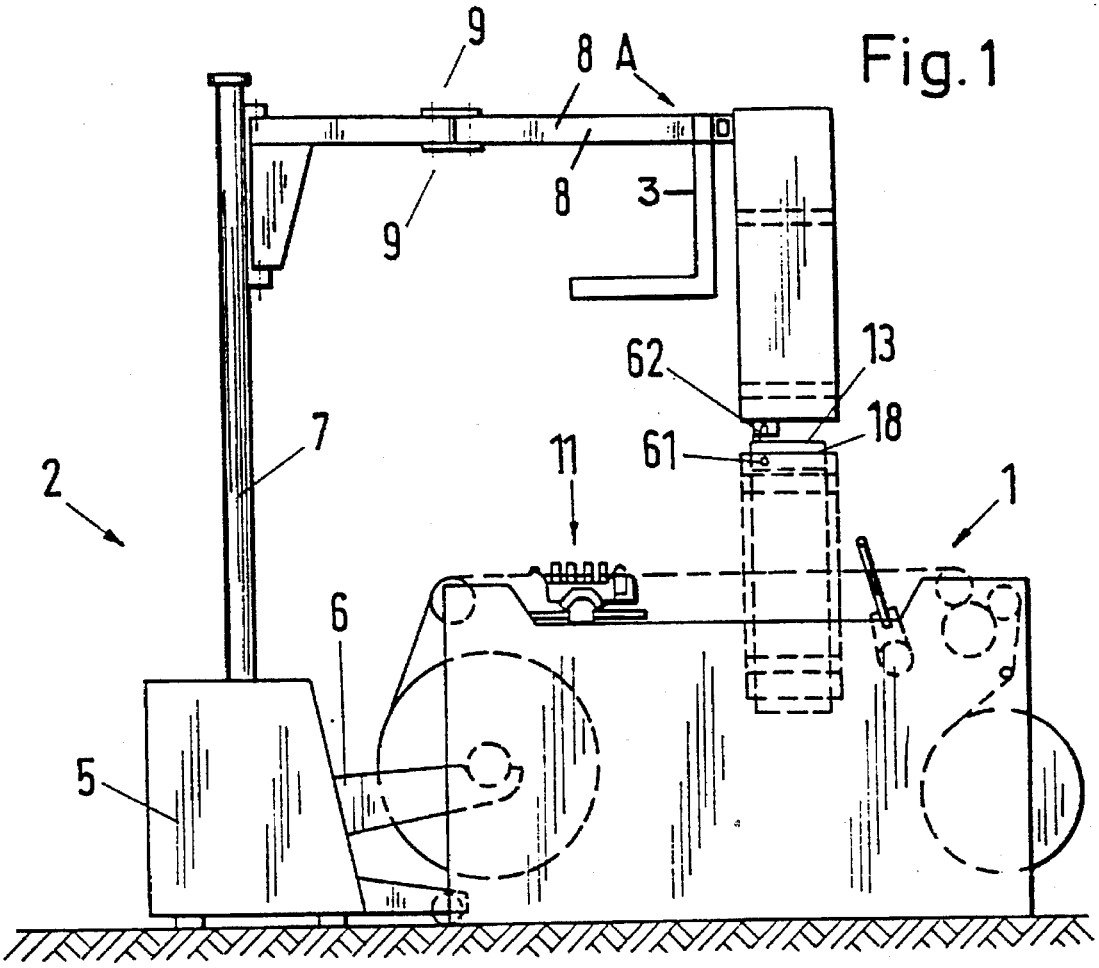
FIG. 1 is a side elevational view a carriage constructed in accordance with the invention.

FIG. 1 shows the position of a loom 1 and a carriage 2 after transferring the harness or heald frame onto the loom.

The carriage 2 comprises a frame 5 with a device 6 for offering up a warp beam, a framework with two posts 7 mounted on the frame 5, two booms 8 which are arranged on the posts and can be moved up and down the posts in synchrony, and a joint 9 to allow the booms 8 to pivot and a carrier 10 (FIG. 2) hinged on the booms 8, a device 3 for offering up the warp stop motion unit 11, and a device 12 for offering up the heald shafts 13.

Figure 2:
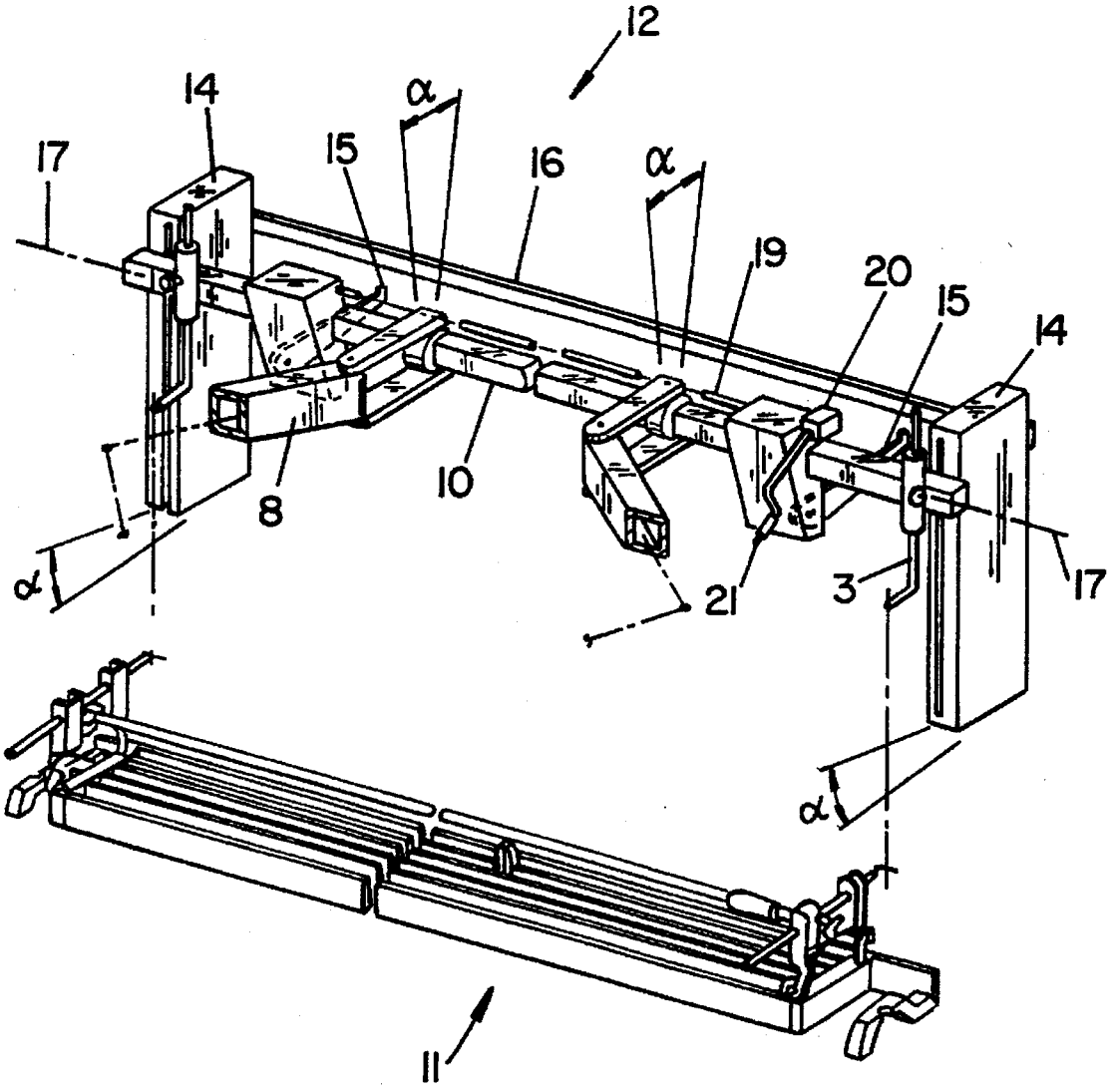
FIG. 2 is a partial perspective view taken in the direction of the arrow A in FIG. 1.

As shown in FIG. 2, the device for transferring the heald shafts is secured to the carrier 10 and includes two receiver apparatuses 14 for the heald shafts and two hangers 15 for the offering up and receipt of the heald shafts. The receiver apparatuses 14 are connected to one another by means of a cross-member 16.

The carrier 10 is arranged on the booms 8 so as to be pivotable about an angle $\alpha$ so that the offering-up device in accordance with the invention can be pivoted about an axis 17 and so that a problem-free support of the receiver apparatus 14 on the support 18 of loom 1 is achieved (FIG. 1). Furthermore, a drive unit 19, 20, 21 is provided for the hangers 15 in order to synchronously actuate the hangers.

Figure 3:
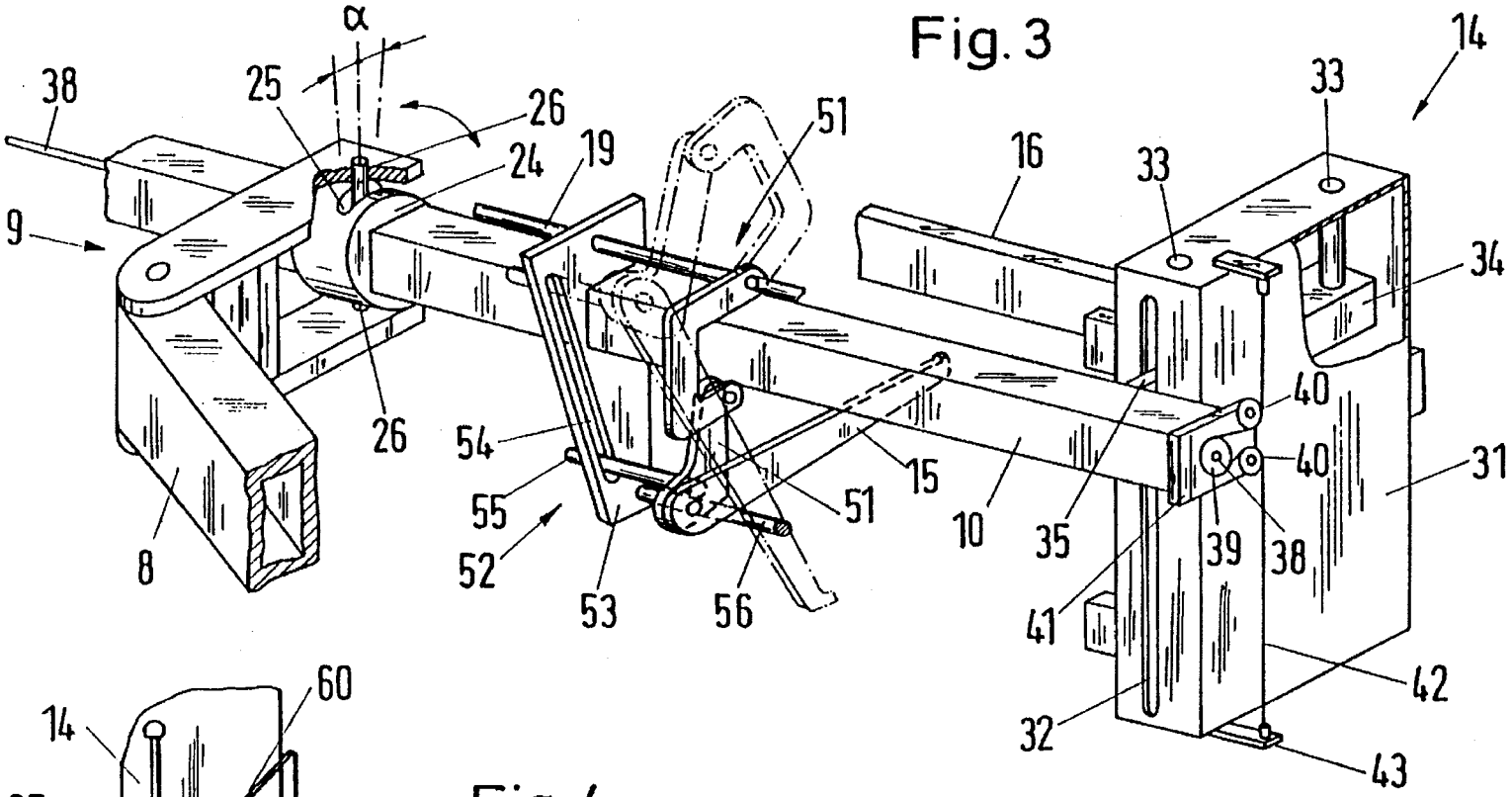
FIG. 3 is a partial perspective view similar to FIG. 2 but on a larger scale.

Reference is made to FIG. 3. The carrier 10 is a tube of rectangular section and is provided with a locator element 24 at the position of connection to the boom 8.

The locator element 24 is of cylindrical shape and is provided with two slots 25 positioned diametrically opposite to one another. Pins 26 protruding into th slots 25 are each secured to the hanger 18 and limit the pivotal movement.

As already mentioned, the transfer device 12 for the heald shafts 13 includes a receiver apparatus 14 and a hanger 15 each of which is arranged on the carrier to the left and right respectively.

The receiver apparatus 14 comprises a housing 31 with an elongate aperture 32 and two posts 33. The receiver apparatus furthermore has a carrier arm 34 guided on the posts and a protector 35 protruding through the elongate aperture and secured to the carrier 10.

The receiver apparatuses 14 are connected via a synchro drive in order to compensate for any differences in the levels of the receiver apparatuses when placing them onto the booms 18. The synchro drive comprises a shaft 38 extending through the carrier 10 and a chain wheel 39 secured to the shaft 38 for each receiver apparatus, two guide wheels 40 arranged on a plate 41 secured to the end face of the carrier, and a chain 42 guided over said wheels and secured at its ends to two brackets 43 provided on the housing 31.

The offering-up devices align themselves. If both receiver apparatuses 14 are not on the same level during lowering, one receiver apparatus will abut first onto the loom, whereas the other receiver apparatus will remain above the loom. Upon further lowering, the carrier 10 moves downward along the apparatus that has abutted first onto the loom. This movement causes a rotation of the shaft 38, with the result being that the other apparatus is driven by the wheel 39 in order to move the other apparatus to thereby compensate the level difference between both apparatuses.

Each hanger 15 is associated with a lever arrangement 51 connecting the carrier to the drive unit 19, 20, 21 and with a connecting link guide 52 which determines the sequence of movements of the hanger 15. Because the drive units are connected the lever arrangement which the hanger is linked, the hanger is lifted or lowered when rotating a crank. The connecting link guide comprises two plates 53 with an elongate aperture 54 in which a lever 55 of the arrangement 51 is guided. For the sake of clarity, only one plate is shown. Furthermore, a rod 56 is arranged between the plates and limits the movement of the hanger 15.

The carriage has two latch mechanisms (shown in FIG. 4) which are each arranged on the receiver apparatus 14 and a kinematic element 60 which is connected to the latch mechanisms in order to synchronously actuate them.

Each latch mechanism comprises on the one hand a pin 61 arranged on the loom support 18 (FIG. 1) and, on the other hand, a guide part 62 and a lever arrangement 63 which can each be brought into engagement with the pin 61 in order to fix the receiver apparatus 14 on the loom or weaving machine. The lever arrangement 63 comprises an actuator lever 64, a gear lever 65 fixedly connected to the actuator lever, a knee lever 66 connected to the actuator lever 64, and a roller 67 rotatably arranged on the knee lever 66.

Figure 4:
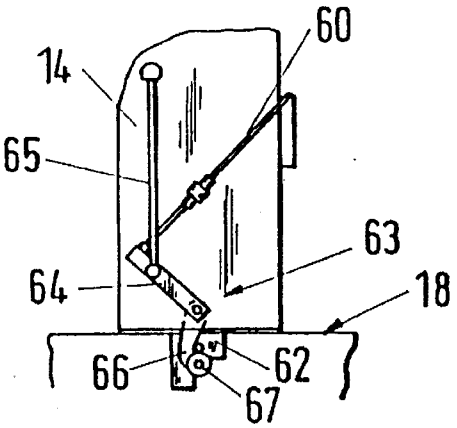
FIG. 4 is a view of the device for latching the offering-up devices on the loom in the latched position.

FIG. 4 illustrates the latch mechanisms in a latched condition. As gear lever 65 moves in a clockwise direction, actuator lever 64 will likewise move in a clockwise manner, due to its attachment to gear lever 65. Based on this rotation of actuator lever 64, knee lever 66 and roller 67 will also pivot in a clockwise manner about an axis defined by the point of attachment between knee lever 66 and actuator lever 64, thus placing the latch mechanism unlached condition.

It is noted that the carriage in accordance with the invention is not limited to the exchange of heald frames on looms but can equally well be applied to heald frame positioning carriages.

What is claimed is:

1. Carriage for changing a harness or heald frame of a loom, said carriage comprising a frame including means for offering up a warp beam, a framework including a horizontally and a vertically adjustable carrier and a device mounted on the carrier for offering up heald shafts, the device including first and second receiver apparatuses and first and second hangers for offering up and receiving the heald shafts, and means operatively coupled with the device permitting pivotal movements of the heald shafts about a substantially horizontal axis concentric with an axis of the carrier.

2. Carriage in accordance with claim 1 including means for displaceably arranging the receiver apparatuses for the heald shafts on the carrier, and including a synchro drive connecting the receiver apparatuses for compensating level differences when placing the receiver apparatuses onto a support of the loom.

3. Carriage in accordance with claim 2, including a cross-member further connecting the receiver apparatuses with one another.

4. Carriage in accordance with claim 1, including a drive unit for synchronously actuating the hangers.

5. Carriage in accordance with claim 1 including for each hanger a drive unit, a lever arrangement with at least one lever member connecting the hanger with the drive unit and a guide for guiding the at least one lever member of the lever arrangement for synchronizing a sequence of movements of the hangers.

6. Carriage in accordance with claim 1, including a latch mechanism for each receiver apparatus for fixing the device on the loom, and a kinematic element connecting the latch mechanisms for common actuation of the latch mechanisms.

7. A carriage according to claim 1 wherein the means permitting pivotal movements permits pivotal movements of the device relative to the carrier.

8. A carriage according to claim 6 wherein the carrier comprises a substantially horizontal bar.

9. A carriage for changing equipment on a loom comprising a frame, a generally horizontally oriented, vertically and horizontally movable carrier, a device mounted on the carrier for presenting the equipment, first and second receiver apparatuses mounted on the carrier, and means permitting relative pivotal movements between the frame and the carrier about an axis concentric with an axis of the carrier.

10. A carriage according to claim 9 wherein the equipment comprises at least one of heald shafts and warp stop motions.

* * * * *